US005671493A

United States Patent [19]

Moon

[11] Patent Number: 5,671,493

[45] Date of Patent: Sep. 30, 1997

[54] WASHINGS WEIGHT DETECTION APPARATUS AND METHOD THEREOF

[75] Inventor: Gyeong Ho Moon, Kyungsangnam-Do, Rep. of Korea

[73] Assignee: LG Electronics Inc., Rep. of Korea

[21] Appl. No.: 499,436

[22] Filed: Jul. 7, 1995

[30] Foreign Application Priority Data

Jul. 7, 1994 [KR] Rep. of Korea ..... 1994-16345

[51] Int. Cl.[6] ..... D06F 33/02

[52] U.S. Cl. ..... 8/159; 68/12.04; 68/12.16

[58] Field of Search ..... 68/12.02, 12.04, 68/12.05, 12.07, 12.12, 12.19, 12.27, 13 R, 12.16; 8/159

[56] References Cited

U.S. PATENT DOCUMENTS

| | | | |
|---|---|---|---|
| 4,803,854 | 2/1989 | Kikuchi et al. | 68/12 R |
| 4,862,710 | 9/1989 | Torita et al. | 68/12 R |
| 4,986,092 | 1/1991 | Sood et al. | 68/12.04 |
| 5,144,819 | 9/1992 | Hiyama et al. | 68/12.04 |

FOREIGN PATENT DOCUMENTS

| | | | |
|---|---|---|---|
| 61-98289 | 5/1986 | Japan | 68/12.04 |
| 2-74289 | 3/1990 | Japan | 68/12.04 |
| 6-281 | 1/1994 | Japan . | |
| 6-280 | 1/1994 | Japan . | |

*Primary Examiner*—Frankie L. Stinson

*Attorney, Agent, or Firm*—Ostrolenk, Faber, Gerb & Soffen, LLP

[57] ABSTRACT

An apparatus for detecting a washing weight of washing machine has the rechecking function to detect the washings weight before and after the supplying of water and a microcomputer for determining the water level according to the detected washing weight. In a method for detecting washing weight of washing machine, if the washings weight is not larger than low level, water is supplied up to lower level and the washings weight is detected, thereby the water level is determined. And if the washings weight is not smaller than medium low level, the water is supplied up to low level and the washing weight is detected, thereby the water level is determined.

6 Claims, 10 Drawing Sheets

FIG. 9
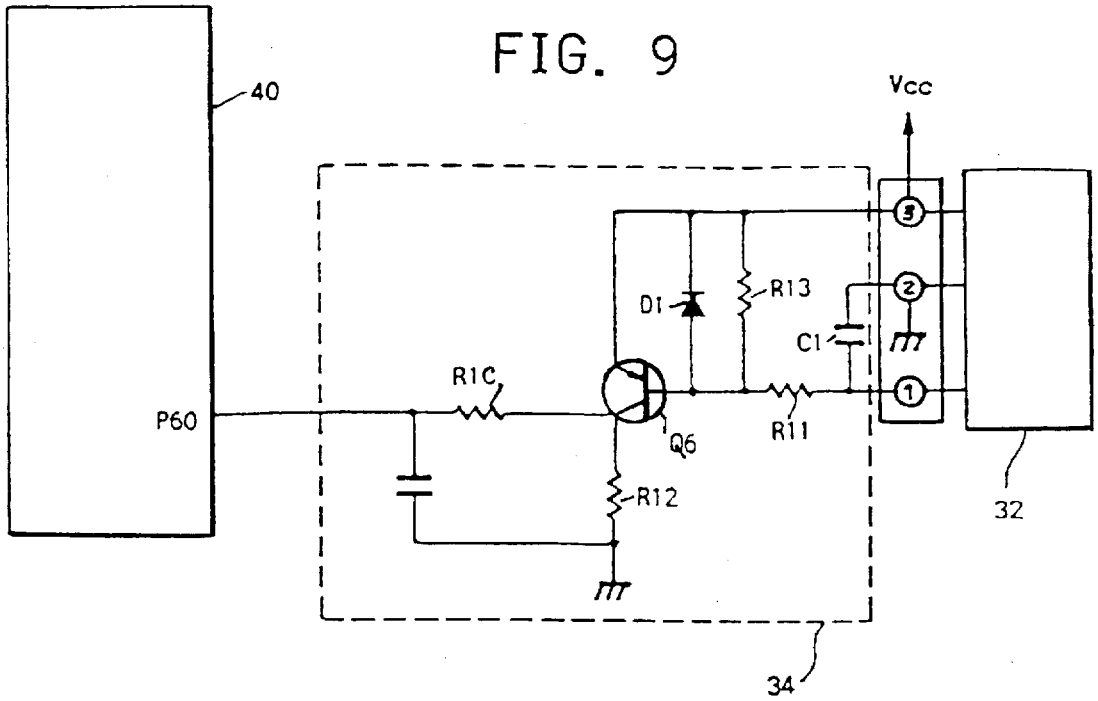
FIG. 10
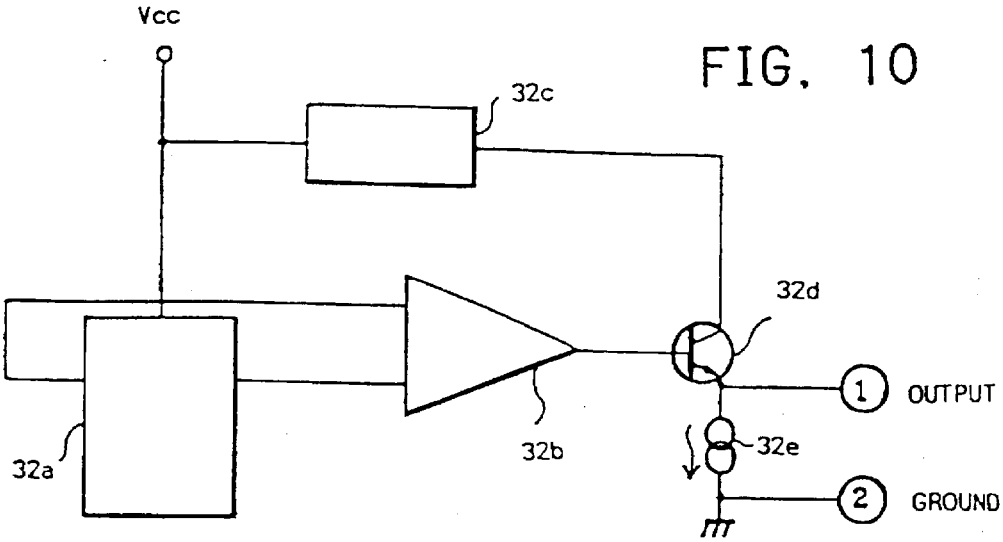
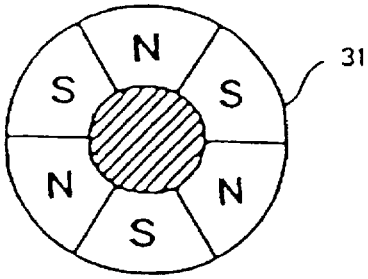
FIG. 11

WASHINGS WEIGHT DETECTION APPARATUS AND METHOD THEREOF

BACKGROUND OF THE INVENTION

The present invention relates to an apparatus and a method for detecting the washings weight of a washing machine, more particularly, to an apparatus and a method which detects the washings weight before the supplying of water and detects the washings weight again after the water is supplied up to level 2 which is lower level where the washings weight is not more than level 3 which is low level, or detects the washings weight again after water is supplied up to level 3 where the washings weight is not less than level 4 which is medium low level so as to prevent the washings weight detection error and a water level determination error.

As shown in FIG. 1, the conventional washing machine comprises a motor 1 for generating a power according to a control of a microcomputer, a clutch 5 for receiving the power through pulley 2, v-belt 3 and clutch pulley 4 and a wing 7 for rotating by the power and swirling water in a water receiving tub 6. Reference numeral 8 denotes clothing.

As shown in FIG. 2, a washings weight detecting circuit of conventional washing machine comprises the microcomputer 9 controlling the total operation, motor driving means 10 including array resistors R3–R6,R9–R10, TRIACs TA1, TA2, capacitors C1–C4, resistors R7,R8, to control the driving of the motor 1, and a washings weight detecting means 11, which comprises diodes D1,D2, photo-coupler PC, transistors Q1,Q2 and resistors R16–R19 which transmit the data to the micro computer after detecting the washings weight with a residual voltage generated by a force of inertia of the motor 1 when the electric power for said motor 1 cuts off.

FIG. 3 is a water level display diagram of the washing machine. The water level is divided into 5 levels or 7 levels.

Hereinafter, the operation of the conventional washing machine are described in detail with reference to FIGS. 1 to 6.

First, if a user selects a key so as to wash the clothing after detecting the washings weight, the microcomputer 9 performs an initial operation. That is, the microcomputer 9 makes the water supply to a water receiving tub 6 by opening the cold and hot water valves (not shown) through the motor driving means 10 to the predetermined water level.

When the water supply operation is completed, the microcomputer 9 outputs high signal through ports P54,P55 alternatively during certain period of time so as to detect the washings weight in the said tub 6. Namely, the high signal which the port P54 outputs is applied to a gate of TRIAC (bidirectional triode-thyristor) TA1 through the array resistors R4,R6,R10 and a switching element Q4 as a trigger signal and makes the TRIAC TA1 turned on, and the outputted high signal from the port P55 is applied to a gate of TRIAC TA2 through array resistors R3,R5,R9 and the switching element Q3 as a trigger signal and makes TRIAC TA2 turned on. Therefore, the inputted alternating currents are applied to the motor 1 through turned on TRIACs TA1,TA2 and the motor 1 starts to operate to make the wing 7 rotate in clockwise or anticlockwise direction.

When the motor 1 is started to operate, the voltage is generated in the motor during certain period of time and is applied to the washing weight detecting means 11 and then the washings weight detecting means 11 makes the voltage generated from said motor 1 into a waveform and input said shaped waveform into the microcomputer 9.

And the microcomputer 9 also outputs the signals through the ports P55,P54 during a certain period of time and then TRIACs TA1,TA2 become turned off, thereby the alternating currents which are applied to the motor are cut off.

However, although the alternating currents are being cut off, the motor 1 is not stopped. It takes time to a complete stop due to the force of inertia.

That is, if the volume of clothing is large, because the friction between the wing 7 and clothing are increased, the motor 1 is stopped within short period of time. On the other hand, if an volume of clothing is small, because the friction between the wing 7 and clothing are decreased, the motor 1 is stopped slowly. Therefore, the residual voltage is generated in the motor 1 during the certain period of time (T2 period) as shown in FIG. 6(A).

And the washings weight detecting means 11 is detecting the residual voltage of the motor 1 generated by inertia force and is transforming the residual voltage into waveform and inputs said shaped waveform to the microcomputer 9. Namely, said generated residual voltage is rectified in half-wave type through resistors R1,R2 and diode D1 and then the rectangulated waveform of FIG. 6(B) is outputted by a light emitting element and a light receiving element. The outputted waveform is transformed transistor Q1 and then is inverted by the transistor Q2, thereby the waveform of FIG. 6(C) is inputted to the microcomputer 9.

The microcomputer 9 counts the number of the inputted waveform from washings weight detecting means 11, determines the water level after recognizing the number of inputted waveforms. For example, the number of the waveforms (T2 period) is in the minimum range, the water level is determined to be level 7 and the washing time is set up longer. On the other hand, the number of the waveforms (T2 period) is in the maximum range, the water level is determined to be level 1 and the washing time is set up short.

FIG. 4 shows a flow chart of the water level determining process according to the key selection by a user. As mentioned above, the determination of a water level and the washing time is done, the next process is performed. At this time, the microcomputer 9 controls the rotation of the wing 7 according to the determined water level, as shown in FIGS. 5(A)–(G). For example, if the water level is high, a real operating rate (operating rate of wing ON position) is large, and if the water level is low, the real operating rate is small.

The real operating rate in case of 7 level $$= \frac{\text{wing ON}}{\text{wing ON} + \text{wing OFF}} = \frac{(t_{AL1} + t_{AL2} + t_{AL3} + \ldots + t_{ALN}) + (t_{AR1} + t_{AR2} + t_{AR3} + \ldots + t_{ARN})}{(t_{AL1} + t_{AL2} + \ldots + t_{ALN}) + (t_{AR1} + t_{AR2} + \ldots + t_{ARN}) + (t_{AP1} + t_{AP2} + \ldots + t_{AP2N})} > 100$$

Where, $t_{AL}$=driving pulse time period in anticlockwise direction, $t_{AR}$=driving pulse time period in clockwise direction, $t_{AP}$=OFF pulse time period.

As shown in FIG. 5, the real driving rate (A–G) is proportioned to the water level.

After the above-mentioned process is finished, the following process is performed. If the washing process is only one time, DRAINAGE, Intermittent SPIN-DRY, SPIN DRYING, PAUSE, WATER SUPPLY, WASH is performed in such an order. If the washing process is more than two times, the said step is repeated.

Then, the dehydrating process is performed, that is DRAINAGE, Intermittent SPIN-DRY, SPIN-DRYING, PAUSE is performed in order, thereby all the washing operation is completed.

However, there are problems in this type of conventional washing machine that the washing efficiency is deteriorated just following the selected water level. For example, if the water level is higher compared to the amount of clothing, the washing process is performed successfully but the entanglement rate of the clothing is high, but if the water level is low by compared to the amount of clothing, the entanglement of the clothing is low but the washing process is not performed well and the damage rate of the clothing is increased.

Also, because the washings weight detection process is performed only one time in order to determine the water level, the total washing efficiency is deteriorated when the washing weight is detected erroneously.

SUMMARY OF THE INVENTION

It is an object of the present invention to provide an new and improved washings weight detection apparatus and a method, thereof which detects the washings weight before the supplying of water and again detects the washings weight after the water has been supplied to lower level where the washings weight is lower than low level, or detects the washings weight again after water is supplied until low level in case that the washings weight is higher than medium low level so as to prevent the washings weight detection error and a water level determination error.

In order to achieve the above-mentioned object, the present invention comprises the washings weight detecting means which converts a change of magnetic pole of a magnet formed in turned off motor shaft into a electric signal and detects the washings weight both in wet washings situation and in dry washings situation and the microcomputer which determines the water level according to the detected washings weight.

A method for detecting the washings weight according to the present invention comprises the steps of (A) first water level determining process including detecting the washings weight before the supplying of water and determining a first water level, (B) second water level determining process including detecting washings weight again after supplying the water to low level when said first water level is higher than medium low level and determining the second water level, (C) first actual water level determining process including (i) comparing the first water level with the second water level (ii) determining the actual water level according to the difference of said two level (iii) supplying the water (iv) proceed the washing operation, (D) third water level determining process including supplying the water to lower level when said first water level is not level is not higher than low level, detecting the washings weight and determining the third water level, (E) 2nd actual water level determining process including comparing the first water level with the third water level and determining the first water level as the actual water level when the first water level is higher than the third water level or the water level difference between the two levels is not larger than one level supplying the water and proceed the operation, and (F) returning to the step (B) when the water level difference between said first level and said third water level is not smaller than two level after canceling the determination of third water level.

BRIEF DESCRIPTION OF THE DRAWINGS

FIG. 9 is a detailed circuit diagram of a waveform shaping circuit;

FIG. 10 is a circuit diagram of the constant-voltage switching circuit;

FIG. 11 is a detailed structure of the magnet of FIG. 7;

DETAILED DESCRIPTION OF THE INVENTION

Preferred embodiments of the present invention are described in detail hereinafter.

Figure 1:
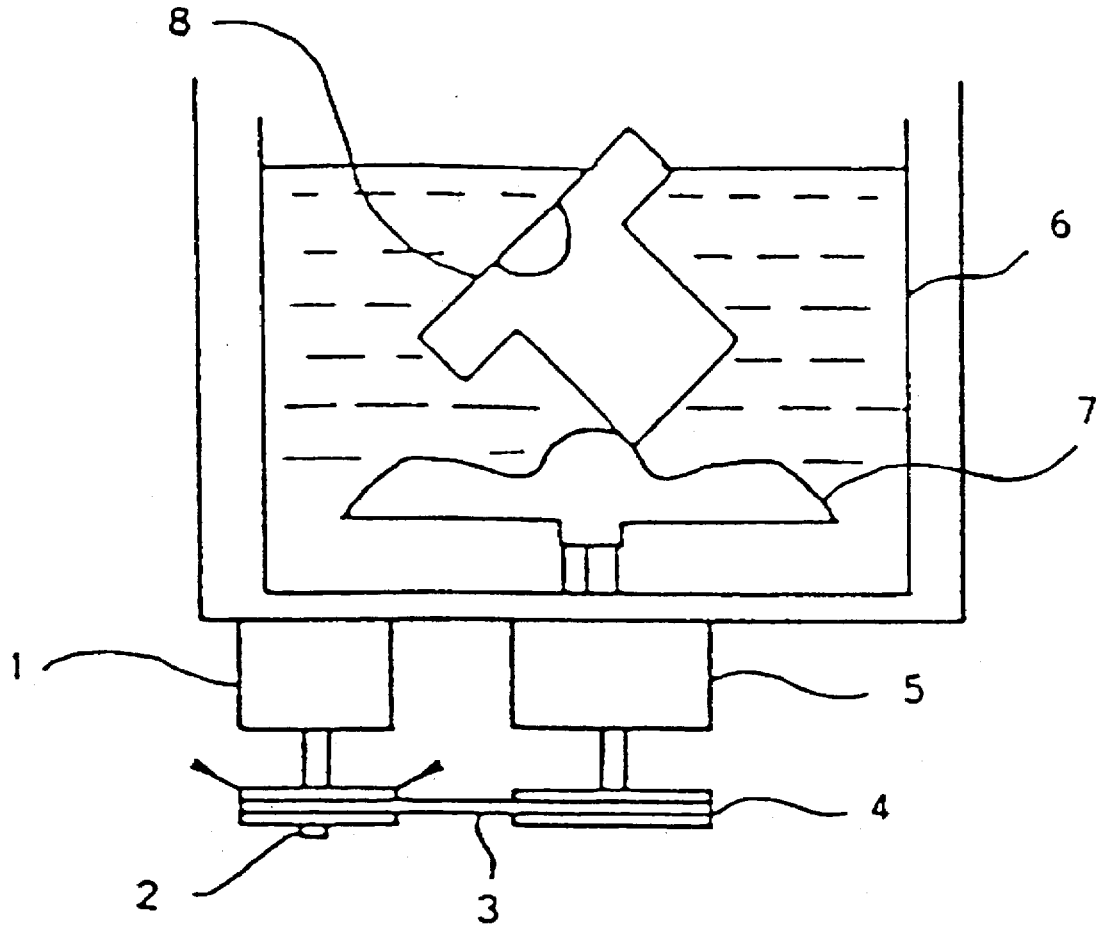
FIG. 1 shows a general structure of a washing machine.
Figure 2:
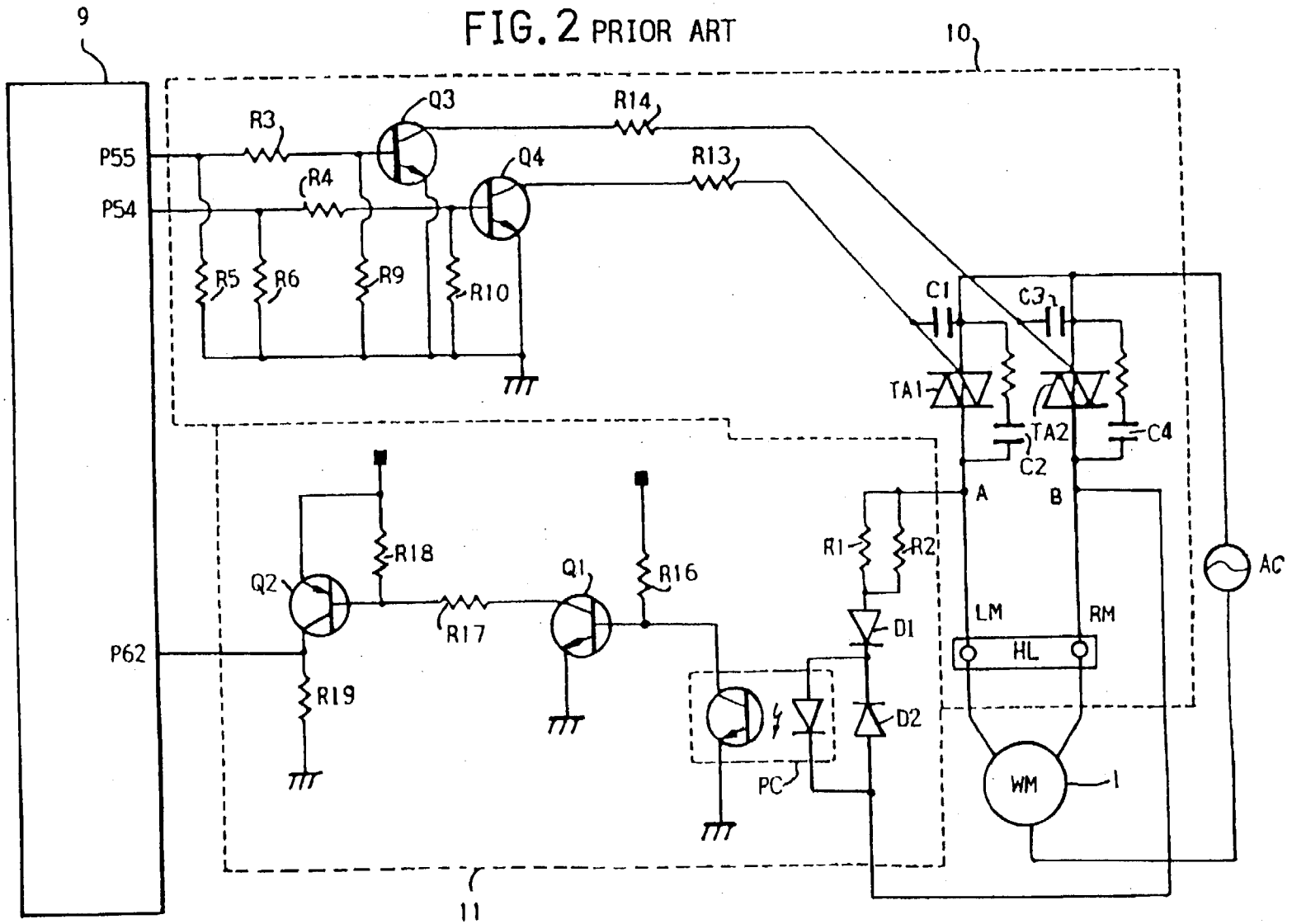
FIG. 2 PRIOR ART
FIG. 2 is the washings weight detecting circuit diagram of conventional washing machine.
Figure 3A:
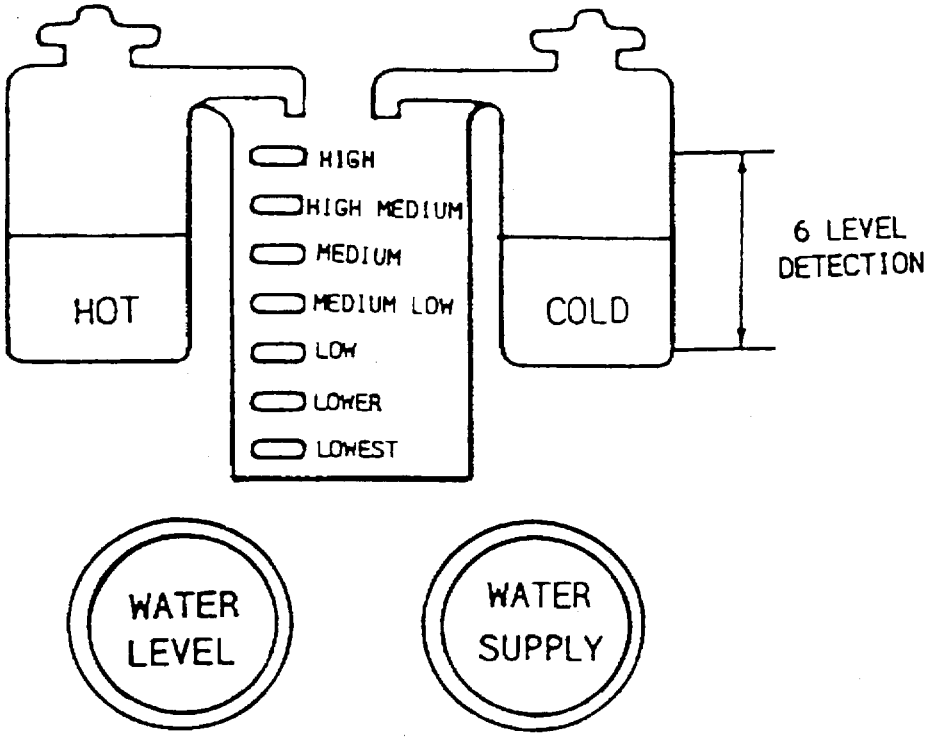
FIG. 3(A) is a water level display diagram of 7 levels.
Figure 3B:
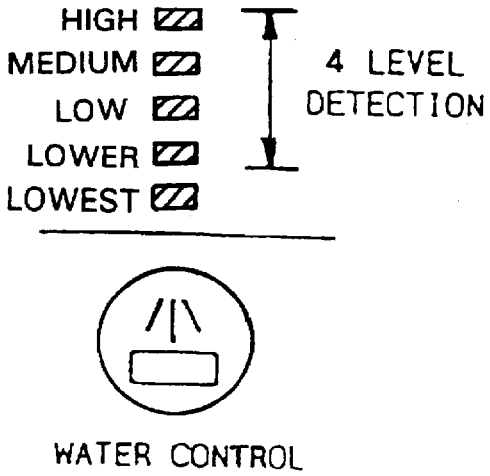
FIG. 3(B) is a water level display diagram of 5 levels.
Figure 4:
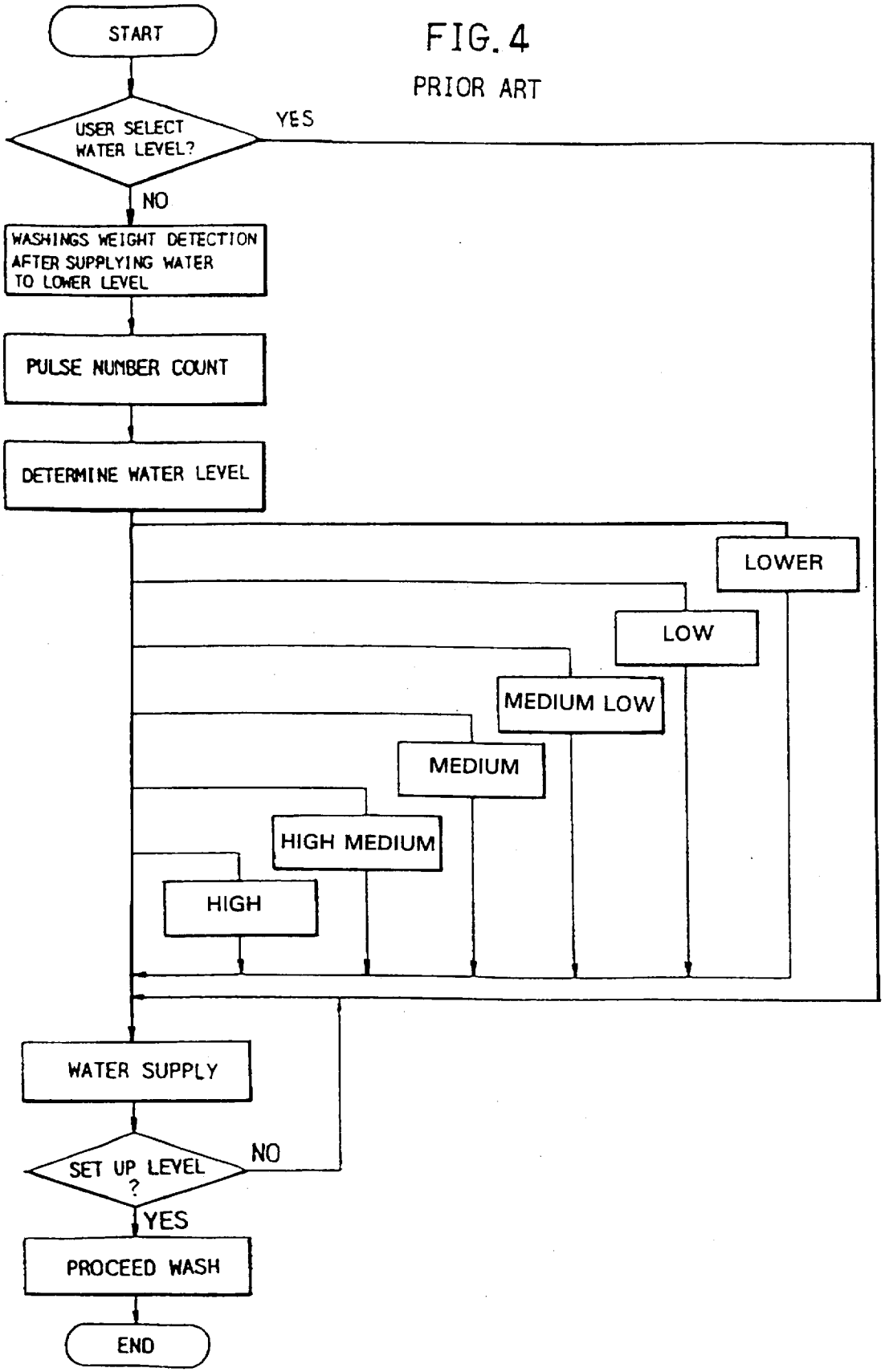
FIG. 4 PRIOR ART
FIG. 4 shows a flow chart of the water level determining process according to the conventional washing machine.
Figures 5A, 5B, 5C, 5D, 5E, 5F, 5G:
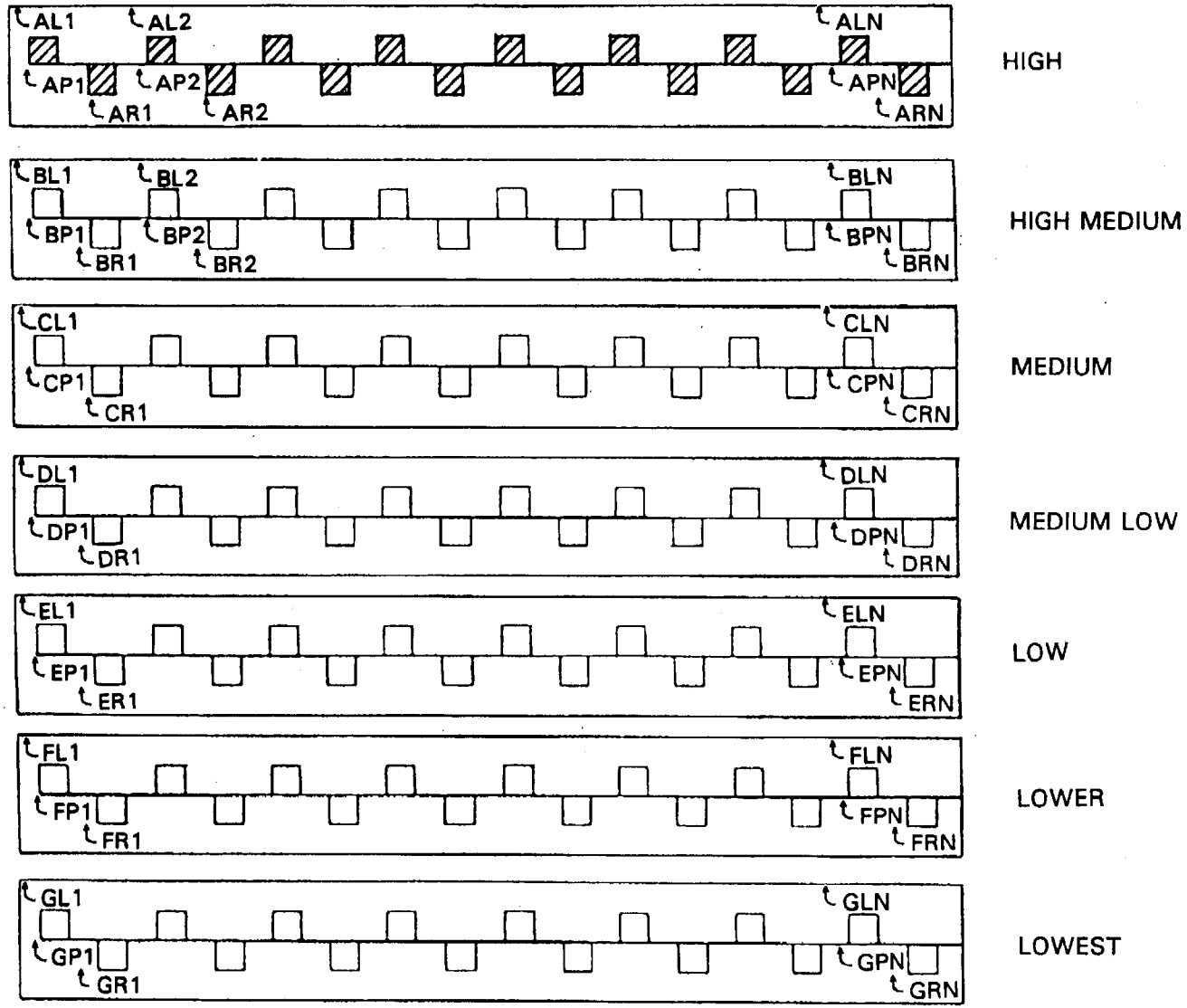
PRIOR ART FIG. 5(A)
FIGS. 5(A)–5(G) are a waveform diagram of the driving of the wing according to the conventional washing machine.
Figures 6A, 6B, 6C:
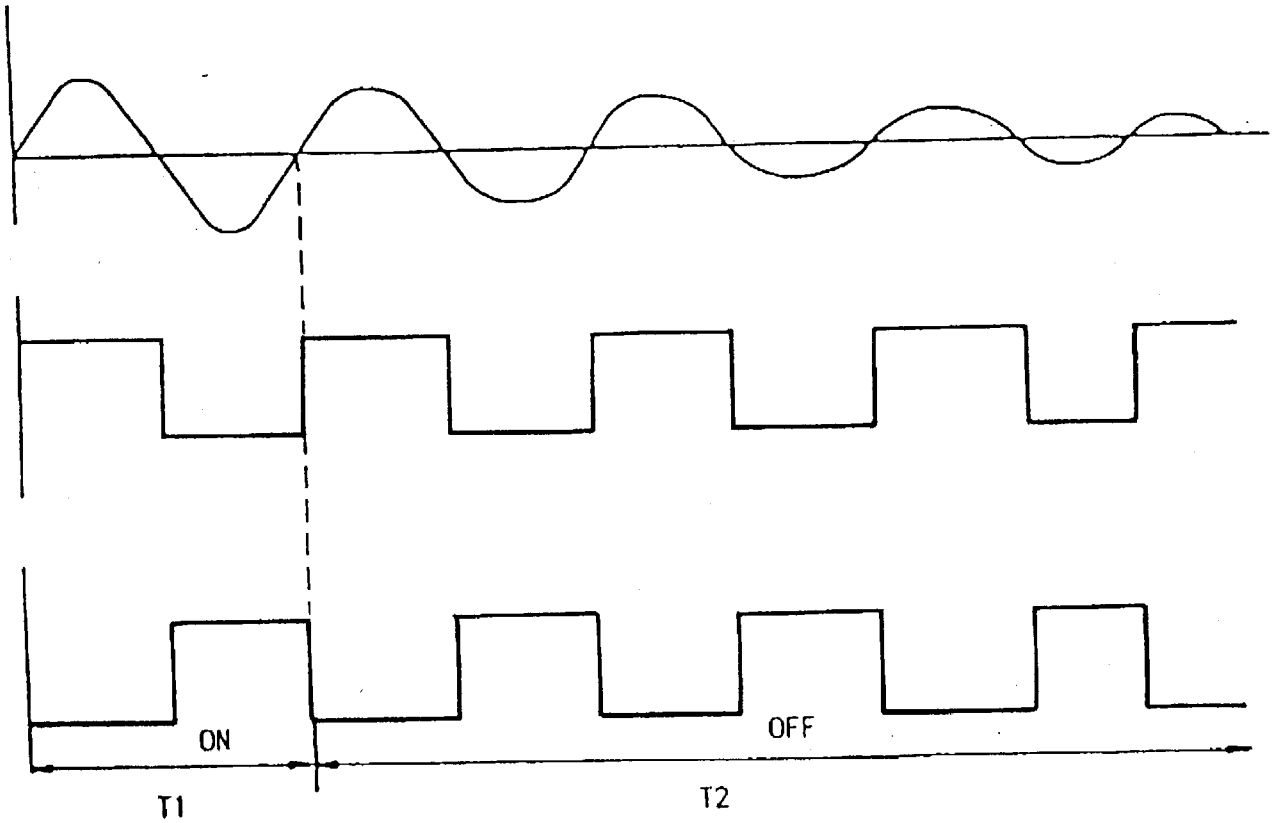
FIG. 6(A) is a waveform diagram of the residual voltage of the motor of FIG. 2.
FIG. 6(B) is a waveform diagram of output of photocoupler in the washing weight detecting means of FIG. 2.
FIG. 6(C) is a waveform diagram the input of the microcomputer of FIG. 2.
Figure 7:
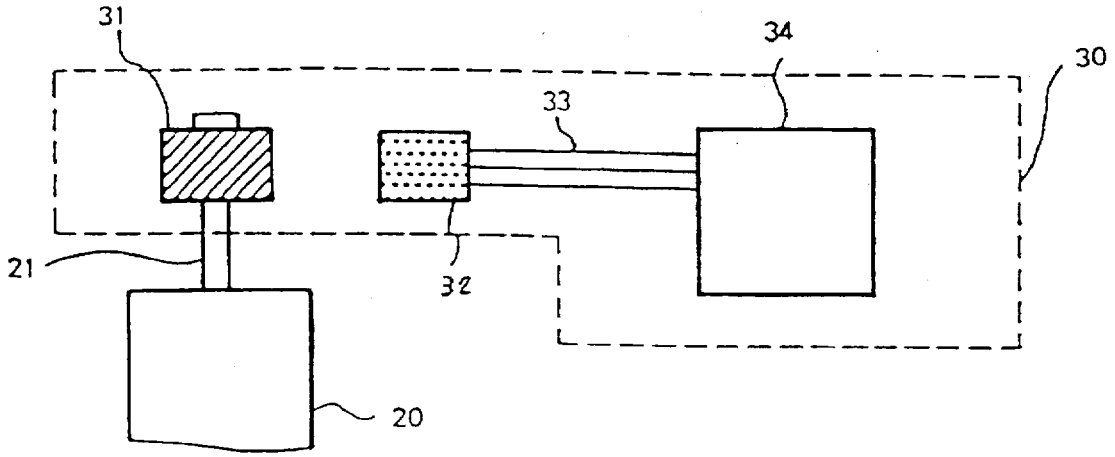
FIG. 7 is a block diagram of the washings weight detecting means of the washing machine according to the present invention.

FIG. 7 is a block diagram of the washings weight detecting means of the washing machine according to the present invention. The washings weight detecting means 30 comprises a magnet 31 connected to a shaft 21 of the motor 20, a constant-voltage switching circuit 32 detecting the change of magnetic pole of said magnet 31, a waveform transforming circuit 34 which is connected to said constant-voltage switching circuit 32 through connecting portion 33 and transforms a output signal of said constant-voltage switching circuit and inputs said transformed signal to the microcomputer (not shown).

Figure 8:
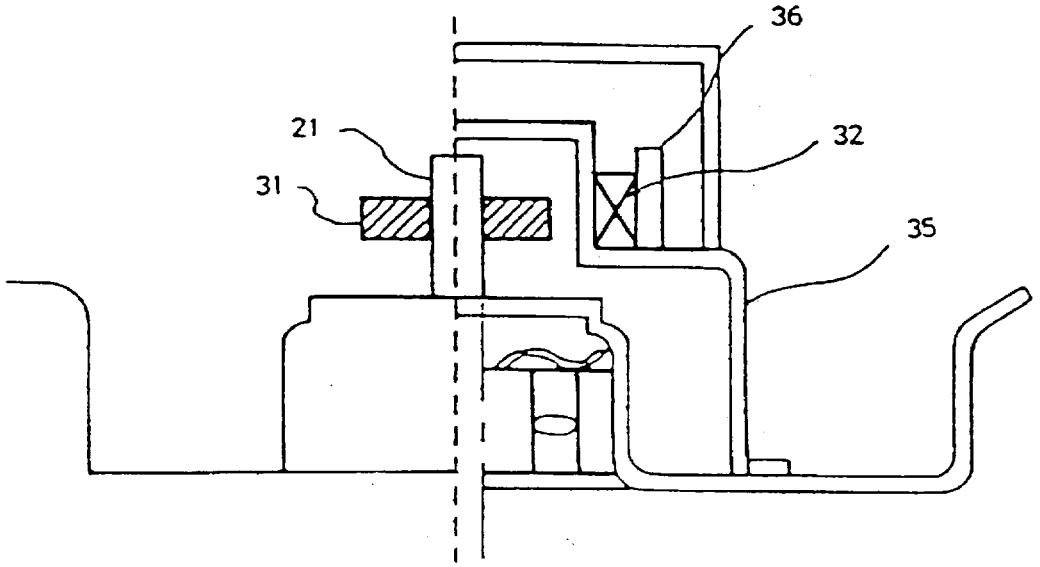
FIG. 8 is a partially sectional view of the washings weight detecting means according to the present invention.

FIG. 8 is a partially sectional view of the washings weight detecting means according to the present invention. The magnet 31 is connected to the shaft 21 of the motor 31, the constant-voltage switching circuit 32 is installed in the opposite side of said magnet 31 at certain distance, and a casing 35 surrounding the constant-voltage switching circuit 32 is installed.

FIG. 9 is a detailed circuit diagram of waveform transforming circuit. The waveform transforming circuit 34, which comprises capacitors C1,C2, resistors R10–R13, a diode D1, and a switching element Q6, transforms the outputted signal of the constant-voltage switching circuit 32 into rectangulated waveform and is connected to the microcomputer 40 which counts the output pulse of the washings weight detecting means, detects the volume of the clothing of clothes and controls the total operation of the washing machine using said volume data.

FIG. 10 is a circuit diagram of the constant-voltage switching circuit. The constant-voltage switching circuit comprises a hall sensor 32*a* for of which output voltage is converted according to the change of magnetic pole of magnet 31, a comparator 32*b* for comparing a reference voltage Vref with the output voltage of said hall sensor 32*a* and outputting the signal of compared value, a constant-voltage element 32*c* for converting the drive voltage Vcc into the constant voltage and outputting said constant-voltage, a switching element 32*d* outputting the voltage for switching ON or OFF the constant-voltage according to the output of the constant-voltage element 32*c* and outputting the result. Reference numeral 32*a* denotes a current source.

Hereinafter, the operation and efficiency of the present invention is described in detail with reference to FIGS. 7 to 14.

Figure 12:
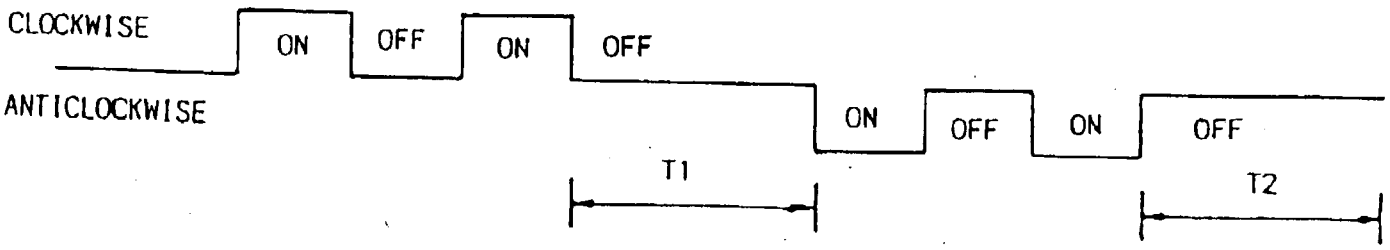
FIG. 12 is a waveform diagram of the driving of the motor of FIG. 7.

First, if a user selects start key when the clothing are put in washing machine, the microcomputer 40 detects the washings weight of washings in dry state. That is, the microcomputer 40 makes the motor 20 and makes the wing rotate in clockwise or anticlockwise direction by predetermined number as shown in FIG. 12. After the microcomputer makes the wing rotate in clockwise direction by predetermined number, and cuts off the power supply to detect the washings weight, and, after the microcomputer makes the wing rotate in anticlockwise direction by predetermined number and cuts off the power supply for the motor 20.

If the microcomputer cuts off the power supply, the motor 20 is not stopped immediately and continues to rotate for certain period of time due to the force of the inertia. At this time, if the volume of the washings is large, the rotation of wing is influenced by the high friction force between the clothing the wing. If the volume of the washings is small, then the rotation of the becomes easy.

As above mentioned, when the motor 20 is turned off, the washings weight detecting means 30 detects the residual rotation of the wing, and further detects the washings weight.

When the microcomputer cuts off the power supply after the wing rotates in clockwise direction, the motor 20 is not stopped immediately and continues to rotate for certain period of time. At this moment, the magnet 31 attached to the center of the motor shaft is also rotating.

The magnet 31, as shown in FIG. 11, comprises three pairs of magnetic pole the constant-voltage switching circuit 32 converts a change of magnetic pole into a electric signal.

Namely, as shown in FIG. 10, the output voltage of the hall sensor 32*a* is changed according to the change of magnetic pole, and the comparator 32*b* compares the reference voltage Vref with said output voltage of the hall sensor 32*a* and outputs the result. At this time, It is assumed that if N pole of the magnet 31 is indicating forward the hall sensor 32*a*, the output voltage of the hall sensor 32*a* is higher than the reference voltage Vref, but if S pole of the magnet 31 is indicating forward the hall sensor 32*a*, the reference voltage Vref is higher than the output voltage of the hall sensor 32*a*. Therefore, if N pole of the magnet 31 is indicating forward the hall sensor 32*a*, the comparator 32*b* outputs the high signal and if S pole of the magnet 31 is indicating forward the hall sensor 32*a*, the comparator 32*b* outputs the low signal. The switching element 32*d* repeats ON, OFF state according to the output of the comparator 32*b* and output the switched constant-voltage. The switched constant-voltage, which is outputted by the switching element 32*d*, is inputted to the waveform transforming circuit 34 and is shaped by the waveform transforming circuit 34 and the transformed waveform is inputted to the port P60 of the microcomputer 40 as the pulse signal. Therefore, the microcomputer 40 counts the pulse signal and detects the washings weight. Thus, the microcomputer can detect the washing weight by counting the number of the pulse. By rotating the wing in anticlockwise direction, the above-mentioned operation can be repeated.

In other words, the microcomputer 40 makes the motor 20 rotate two times in clockwise direction, then cuts off the power supply as shown in FIG. 12 (T1 period) and counts the residual rotation pulse. After the count is completed, the microcomputer 40 makes the motor 20 rotate two times in anticlockwise direction, then again cuts off the power supply as shown in FIG. 12 (T2 period) and counts the residual rotation pulse.

After that, the microcomputer 40 detects the washings weight (S2) by the number of the pulse being counted in said OFF period (T1+T2), determines a first water level W1 and displays the volume of the detergent (S3) being used.

At this time, the determined water level is not displayed and the volume of the detergents only displayed in the water level display means and detergent display means while the determined water level data is stored in internal memory.

Then, the microcomputer 40 determines a second water level W2 according to the first water level W1.

If the first water level is not less than level 4 which is medium low level, water is supplied until level 3 which is low level (S5–S6), the washings weight is detected by the above-mentioned method and the second water level W2 is determined (S7–S9).

Then, the microcomputer 40 compares the volume of the first water level with that of the second water level and calculates the water level difference. If the water level difference is not more than one level (for example, W1=level 6 which is medium high, W2=level 5 which is medium), the first water level W1 is determined to be the actual water level W1 (S11), the actual water level is displayed through a water level display means and detergent display means of FIG. 13 (S12). Then, the water is supplied corresponding to the determined actual water level (S13), the washing is continued (S15).

If the water level difference is not more than one level, the washings weight detection error rate, which results when the wet clothes is contained, is trivial. Generally, the washings weight detection before the supplying of water is more accurate than the washings weight detection after the supplying of water. But, when the washings weight is detected before the supplying of water, if the wet clothes is contained, the detection rate is lowered and the water level will be determined higher than actual volume of the clothing. Also, when the washings weight is detected after the supplying of water, the washings weight detection error, which results when the wet clothes is contained, may be decreased, but because the water supplying time is required, the washings weight detection time period takes lower.

When the water level difference W1–W2 is not less than two level, that is caused by wet clothing when the first water level is determined, the detected second water level after water supply to low level is determined to be the actual water level W2 (S16). The actual water level W2 is displayed through a water level display means and detergent display means of FIG. 13 (S12). Then, water is supplied to corresponding actual water level W2, the washing operating is processed (S13–S15).

On the other hand, in the above-mentioned step S4, if the first water level detected in step S4 is not more than level 3 which is low level, water is supplied until level 2 which is lower level (S17–S18), the washings weight is detected following the same method mentioned above and the third water level W3 is determined (S19–S21).

Figure 13:
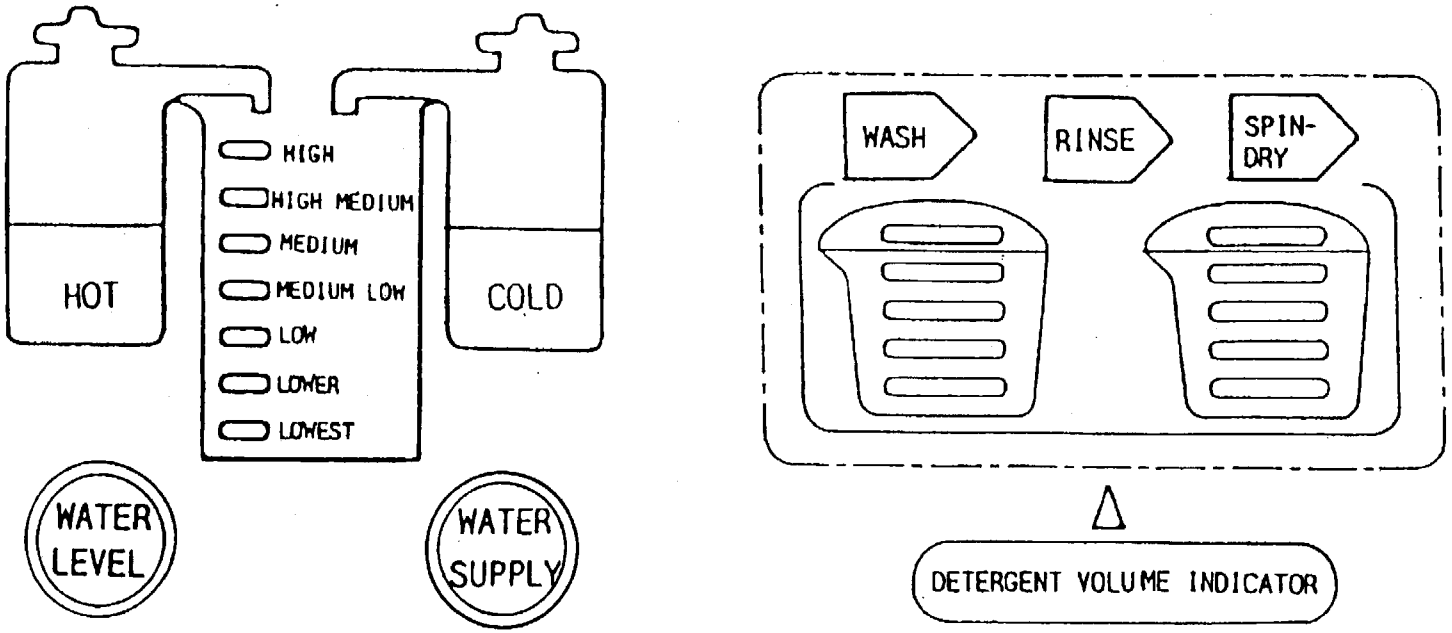
FIG. 13 is a water level display and a detergent display diagram of the washing machine according to the present invention.
Figure 14:
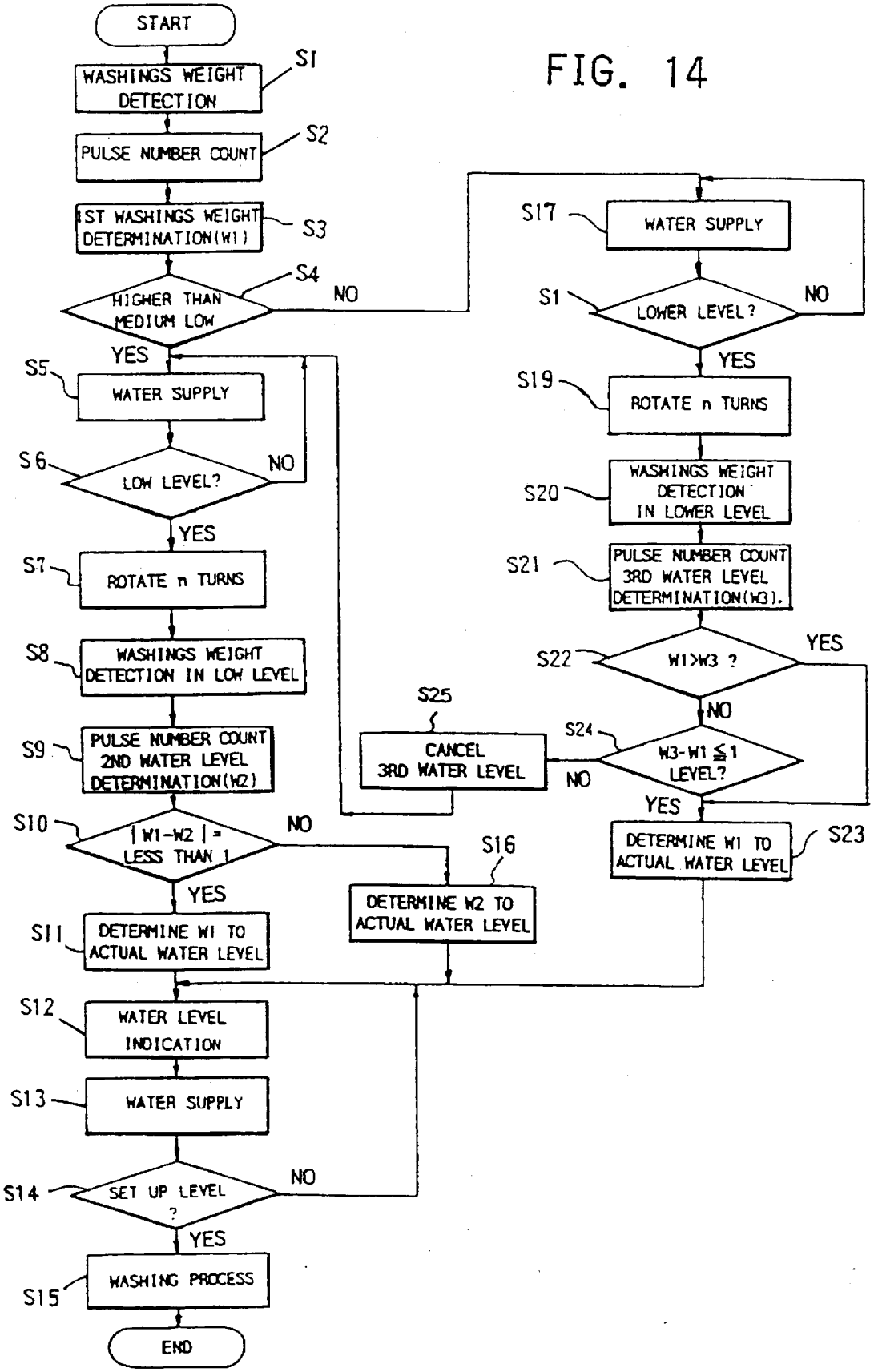
FIG. 14 shows a flow chart of the washing weight detecting process of the washing machine according to the present invention.

Then, the microcomputer 40 compares the volume of the first water level W1 with that of the third water level W3 (S22) and if the first water level W1 is higher than the third water level W3, the first water level W1 is determined to be the actual water level W1 (S23), the actual water level is displayed through the water level display means and the detergent display means of FIG. 13 (S12). Then, water is supplied corresponding to the determined first water level (S13), the washing operation is processed (S15).

If the first water level W1 is not higher than the third water level W3, the water level difference is calculated and if the water level difference is not more than one level, the first water level W1 is determined to be the actual water level W1 (S23–S24), the actual water level is displayed through a water level display means and detergent display means of FIG. 13 (S12). Then, water is supplied until the first water level (S13), the washing operation is processed (S15).

Also, if the water level difference is not less than two level, the third water level W3 is canceled (S25) and returned to the above-mentioned step (S5–S16) than the washing operation is continued.

In the type where the washings weight is detected after the supplying of water, the washings weight detecting rate is low when the water supply is low (in lower level) and the volume of clothing is large. Accordingly, if the water level difference is large, water is supplied until level 3 and the washings weight is detected. If the washings weight is not more than level 3 which is low level, it is preferred that water is supplied until level 2 which is lower level and the washings weight is detected. And if the washings weight is not less than level which is medium low level, it is preferred that water is supplied until level 3 and the washings weight is detected.

As above mentioned, the present invention detects the washings weight before and after the supplying of water. Therefore, the present invention is further accurate in the washings weight detection and decrease the entanglement of clothing. Even when a user set up the water level erroneously, the selection error can be corrected and the efficiency of washing machine can be improved.

While specific embodiments of the invention have been illustrated and described wherein, it is to realize that modifications and changes will occur to those skilled in the art. It is therefore to be understood that the appended claims are intended to cover all modifications and changes as fall within the true spirit and scope of the invention.

What is claimed is:

1. An apparatus for detecting washings weight of washing machine comprising:

washings weight detecting means for detecting the washings weight before and after the supplying of water; and control means for determining a water level according to said detected washings weight;

wherein said washing weight detecting means comprises:

a constant-voltage switching circuit for converting a change of a magnetic pole of a magnet into a electric signal when a motor is turned off; and a waveform transforming circuit connected to said constant-voltage switching circuit transforms an output of said constant-voltage switching circuit and inputs a converted signal to said control means.

2. An apparatus for detecting washings weight of washing machine comprising:

a constant-voltage switching circuit for converting a change of a magnetic flux in a magnet mounted around a motor into a electric signal when said motor is turned off; and a waveform transforming circuit for transforming an output of said constant-voltage circuit into a rectangular pulse waveform, said waveform transforming circuit being connected to said constant-voltage circuit.

3. A method for detecting a washings weight of washing machine comprising the steps of:

A) first water level determining process including, detecting said washings weight before the supplying of water and determining the first water level;

B) second water level determining process including, detecting washing weight again after supplying the water to low level when said first water level is higher than medium low level, and determining the second water level;

C) first actual water level determining process, including, comparing said first water level with said second water, determining the actual water level according to the difference of said two levels, supplying the water, and proceed the washing operation;

D) third water level determining process including, supplying the water up to lower level when said first water level is not higher than low level, detecting said washings weight, and determining a third water level;

E) second actual water level determining process including, comparing said first water level with said third water level and determining said first water level as the actual water level when said first water level is higher than said third water level or a water level difference between the two levels is not larger than level 1 which is lowest level supplying the water and proceed the washing operation; and F) returning to the step B) when said water level difference is not smaller than two level after canceling the determination of third water level.

4. A method according to claim 3, wherein said step B) comprising the process of:

(a) supplying water until level which is low level when said first water level is not smaller than level 4 which is medium low level;

(b) rotating a motor in clockwise or anticlockwise direction by the predetermined number and detecting said washings weight; and (c) determining a second water level according to said detected washings weight.

5. A method according to claim 3, wherein said step (C) comprising the process of:

(a) comparing said first water level with said second water and calculating a water level difference;

(b) determining said first water level to a actual water level when said water level difference is not larger than one level;

(c) determining said actual water level to a actual water level when said actual water level difference is not smaller than two level; and (d) displaying said actual water level, supplying water according to said actual water level and returning to washing process.

6. A method according to claim 3, wherein said step (D) comprising the process of:

(a) supplying water up to level 2 which is lower level when said first water level is not higher than level 3 which is low level;

(b) rotating a motor in clockwise or anticlockwise direction by the predetermined number and detecting said washings weight; and (c) determining a third water level according to said detected washings weight.

* * * * *